US006488368B2

(12) United States Patent
Petersen et al.

(10) Patent No.: US 6,488,368 B2
(45) Date of Patent: Dec. 3, 2002

(54) MANIFOLD FOR PROVIDING FLUID CONNECTIONS BETWEEN CARRIAGE-MOUNTED INK CONTAINERS AND PRINTHEADS

(75) Inventors: Daniel W. Petersen, Philomath, OR (US); Charles R. Steinmetz, Corvallis, OR (US); Scott D. Sturgeon, Vancouver, WA (US); Jeffrey T. Hendricks, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/772,250

(22) Filed: Jan. 26, 2001

(65) Prior Publication Data

US 2002/0101487 A1 Aug. 1, 2002

(51) Int. Cl.[7] ..... B41J 2/175
(52) U.S. Cl. ..... 347/85
(58) Field of Search ..... 347/84, 85, 86, 347/87; 264/5, 250, 263

(56) References Cited

U.S. PATENT DOCUMENTS 5,138,344 A 8/1992 Ujita ..... 347/86
5,719,608 A * 2/1998 Sabonis et al. ..... 347/85
6,068,370 A 5/2000 Miller et al. ..... 347/85
6,145,961 A * 11/2000 Otsuki ..... 347/43
6,264,313 B1 * 7/2001 Mackowiak et al. ..... 347/85

FOREIGN PATENT DOCUMENTS

EP 0900663 A2 3/1999 ..... B41J/2/21

* cited by examiner

*Primary Examiner*—Anh T. N. Vo
(74) *Attorney, Agent, or Firm*—Larry D. Baker

(57) ABSTRACT

Disclosed is a manifold providing fluid connections between a plurality of carriage-mounted ink reservoirs and multiple carriage-mounted printheads, the manifold having ink conduits allowing the spacing, ordering, or number of printheads to differ from the spacing, ordering, or number of ink reservoirs. The manifold also serves to mechanically isolate the printheads from the ink reservoirs, such that replacement of one or more reservoir does not adversely affect the alignment of the printheads. The manifold allows simple optimization of a printing system to a particular application by replacing the manifold with one of a different configuration.

3 Claims, 7 Drawing Sheets

MANIFOLD FOR PROVIDING FLUID CONNECTIONS BETWEEN CARRIAGE-MOUNTED INK CONTAINERS AND PRINTHEADS

TECHNICAL FIELD OF THE INVENTION

The present invention relates generally to fluid supply methods and apparatus for ink jet printers, and more specifically to a manifold providing fluid connections between a plurality of carriage-mounted ink containers and multiple printheads.

BACKGROUND OF THE INVENTION

Ink jet printers are well known in the art. The most common type of inkjet printer uses thermal excitation of the ink to eject droplets through tiny nozzles, or orifices, onto a print media. Other ink jet mechanisms, such as the use of piezoelectric transducers or wave propagation as ink droplet generators, are also well understood. With all ink jet technologies, the ink jet pen is typically mounted on a carriage which is scanned across the print media; dot matrix manipulation of the droplets provides alphanumeric character and graphics printing capabilities. To provide a color printing capability, pens for each primary color (cyan, magenta, and yellow) are commonly used, typically in addition to black.

The ink jet pen itself may have a self-contained reservoir for storing ink and providing appropriate amounts of ink to the printhead during a printing cycle. These self-contained pens are commonly referred to in the art as print cartridges. If a reusable, semi-permanent pen rather than a print cartridge is employed, ink is either supplied from a remote, off-axis (or off-board), ink reservoir, or the ink reservoir is mounted on the carriage with the pen.

In the past, printers have been designed with semi-permanent or permanent printheads mounted to a carriage. These printheads would each include a printhead fluid inlet, such as a conduit terminating with a filter. The filters would prevent particles from entering the printheads and would act as check valves, preventing the printheads from depriming. Ink containers containing foam would have fluid outlets for connecting to the filters. Typically, each fluid outlet would include an orifice for receiving a printhead fluid inlet. Thus, the ink containers would mount directly to the carriage and to the printhead fluid inlets.

Ink jet printers are used for a wide variety of printing applications, ranging from simple black-text printing to the production of photographic-quality color prints. For most ink jet printer users, color inks (cyan, magenta, yellow) are used up at a significantly different rate than black inks, with the relative use rate of black and color inks dependent upon the type of user. For example, an office user may use primarily black ink for printing black and white documents. A photographer, on the other hand, may tend to use the color inks at a higher rate. Different configurations of ink reservoirs are therefore desirable for different printing applications.

Although the same basic scanning mechanism and carriage may serve well for many different applications, different printhead configurations are often desirable in different printing situations. The printhead configuration may be optimized for speed, color print quality, cost, or other factors. The office worker may be primarily interested in print speed, while the photographer may be primarily interested in image quality. Other users, such as home computer users, may be primarily interested in the low initial cost of a printer.

Other considerations may dictate a configuration of ink reservoirs which is not conducive to direct fluid connections between the ink reservoirs to the pens. A large reservoir may be used for black ink, and second single reservoir may contain all three primary colors. The ink fluid connections for the color inks will necessarily be relatively close together on the color ink reservoir. The linear spacing of the reservoirs along the scan axis will therefore differ from an optimal spacing of the printheads.

With direct fluid connection between the ink reservoirs and pens, the connection force of the containers can affect alignment between separately mounted printheads, affecting print quality. Over time, as ink reservoirs are used and replaced, the print quality of the printer can degrade.

There is therefore a need for methods and apparatus which allow ink jet printers to be easily configured for different printing applications, and which prevent the removal and installation of ink reservoirs from adversely affecting the alignment of the printheads.

SUMMARY OF THE INVENTION

It is an object of the present invention to provide a manifold affording fluid connections between a plurality of carriage-mounted ink reservoirs and multiple printheads, the manifold having ink conduits allowing the spacing, ordering, or number of printheads to differ from the spacing, ordering, or number of ink reservoirs. The manifold also serves to mechanically isolate the printheads from the ink reservoirs, such that replacement of one or more reservoir does not adversely affect the alignment of the printheads.

It is a further object of the invention to provide a printing system adapted to accept different manifold configurations, whereby the printing system may be optimized to a particular use by changing the manifold.

It is a still further object of the invention to provide manifolds configured to supply ink to more than one printhead from a single ink reservoir, allowing for higher printer performance by, for example, allowing the same linear ordering of printhead ink colors in both carriage scan directions.

The present invention also provides a method of configuration a printer system to a particular application by changing the manifold, and methods of manufacturing manifolds and affixing them to printer carriages.

BRIEF DESCRIPTION OF THE DRAWINGS

FIG. 4(*a*) shows the manifold concept utilized in a "standard" configuration of ink supplies and printheads;

FIG. 4(*b*) shows the manifold concept utilized to relocate the black printhead between two color printheads to allow underprinting of the black ink to shorten drying times;

FIG. 4(*c*) shows how the manifold concept may also be utilized with separate ink supplies for each of the primary colors;

FIG. 4(*d*) shows the manifold concept used to distribute ink to duplicate sets of printheads, allowing the printer to print in both scan directions;

FIG. 4(*e*) shows the manifold concept used in a printer for high-quality color printing; and FIG. 4(*f*) shows the manifold concept used in a low-cost printer have less expensive dual printheads.

DESCRIPTION OF THE PREFERRED EMBODIMENT

Overview of the Invention

Figure 1:
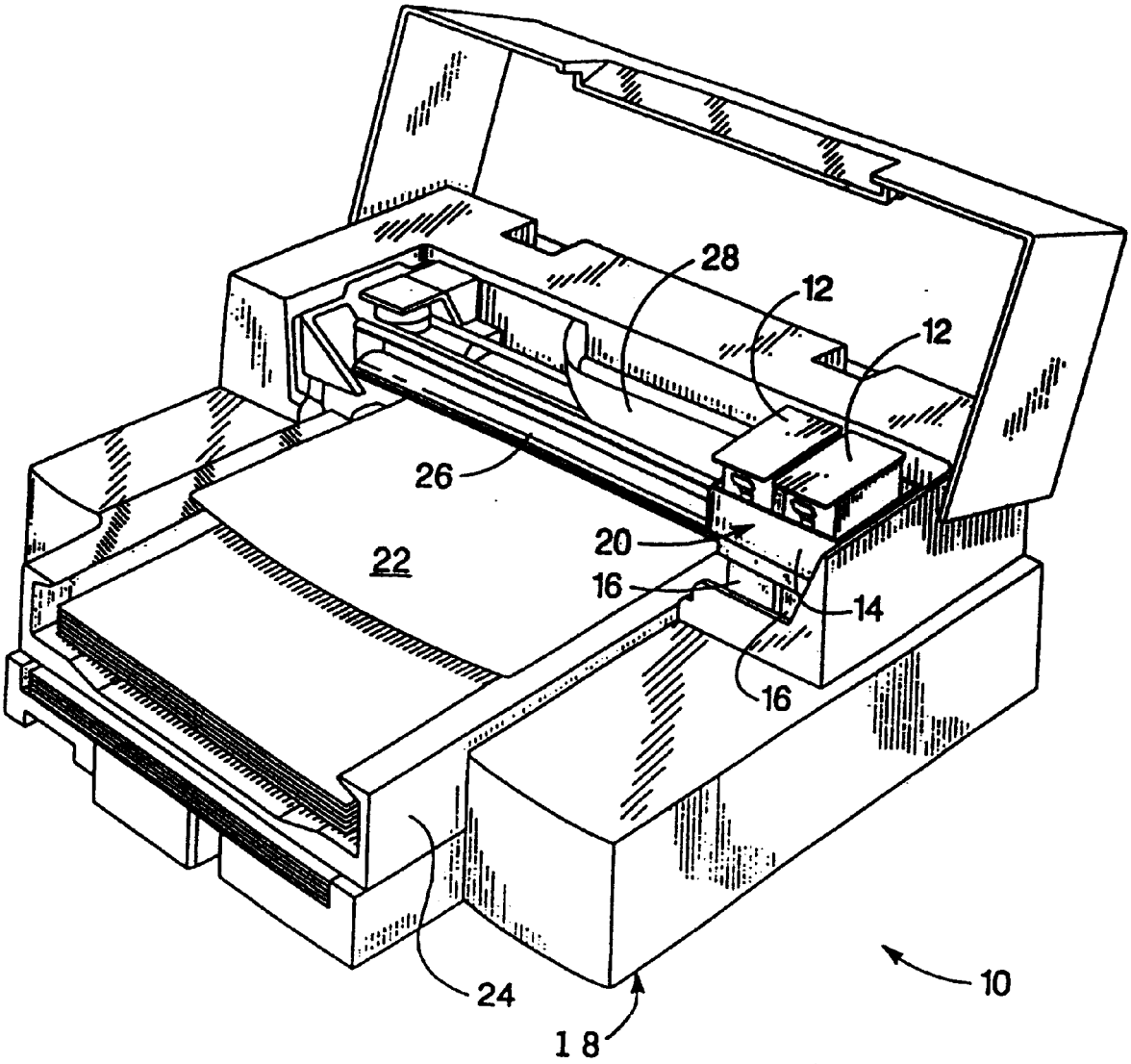
FIG. 1 is a perspective view of a typical ink jet printing system in which the manifold of the present invention may be incorporated. The printing system is shown with a cover opened to illustrate the relative placement of the carriage mechanism, a plurality of replaceable ink containers, the manifold, and the multiple printheads.

FIG. 1 is a perspective view of a typical printing system 10 shown with its cover open, that includes a plurality of replaceable ink containers 12 that are installed in a receiving station 14. With the replaceable ink containers 12 properly installed into the receiving portion 14, ink is provided from the replaceable ink containers 12 through the manifold of the present invention (not visible in this view) to inkjet printheads 16. The inkjet printheads 16 are responsive to activation signals from a printer portion 18 to deposit ink on print media. As ink is ejected from the printheads 16, the printheads 16 are replenished with ink from the ink containers 12. The ink containers 12, receiving station 14, and inkjet printheads 16 are each part of a scanning carriage that is moved relative to a print media 22 to accomplish printing. The printer portion 18 includes a media tray for receiving the print media 22. As the print media 22 is stepped through a print zone, the scanning carriage 20 moves the printheads 16 relative to the print media 22. The printer portion 18 selectively activates the printheads 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printheads 16 by means of an electrical link such as a ribbon cable 28.

The ink receiving station 14 (including the manifold) is in fluid communication with the printheads 16 for providing ink to the printheads.

The manifold of the present invention adds a level of mechanical isolation between the printheads and the ink containers. In printing systems with user-replaceable printheads, biasing systems are incorporated to maintain proper alignment of the printheads within the system to maintain print quality. Even with a biasing system in place, alignment of the pens is at risk if subject to unexpected forces. In the case of a printhead which is coupled directly to a separate user-installed ink container, the forces exerted by the user on the ink container may be directly transmitted to the printhead thereby knocking it out of alignment In the case of a system incorporating a manifold, the user-applied forces are primarily transmitted to the manifold assembly thereby reducing or eliminating the forces transmitted to the printhead. In this manner the printhead is much less likely to be mis-aligned when the user replaces an ink container.

Figure 2:
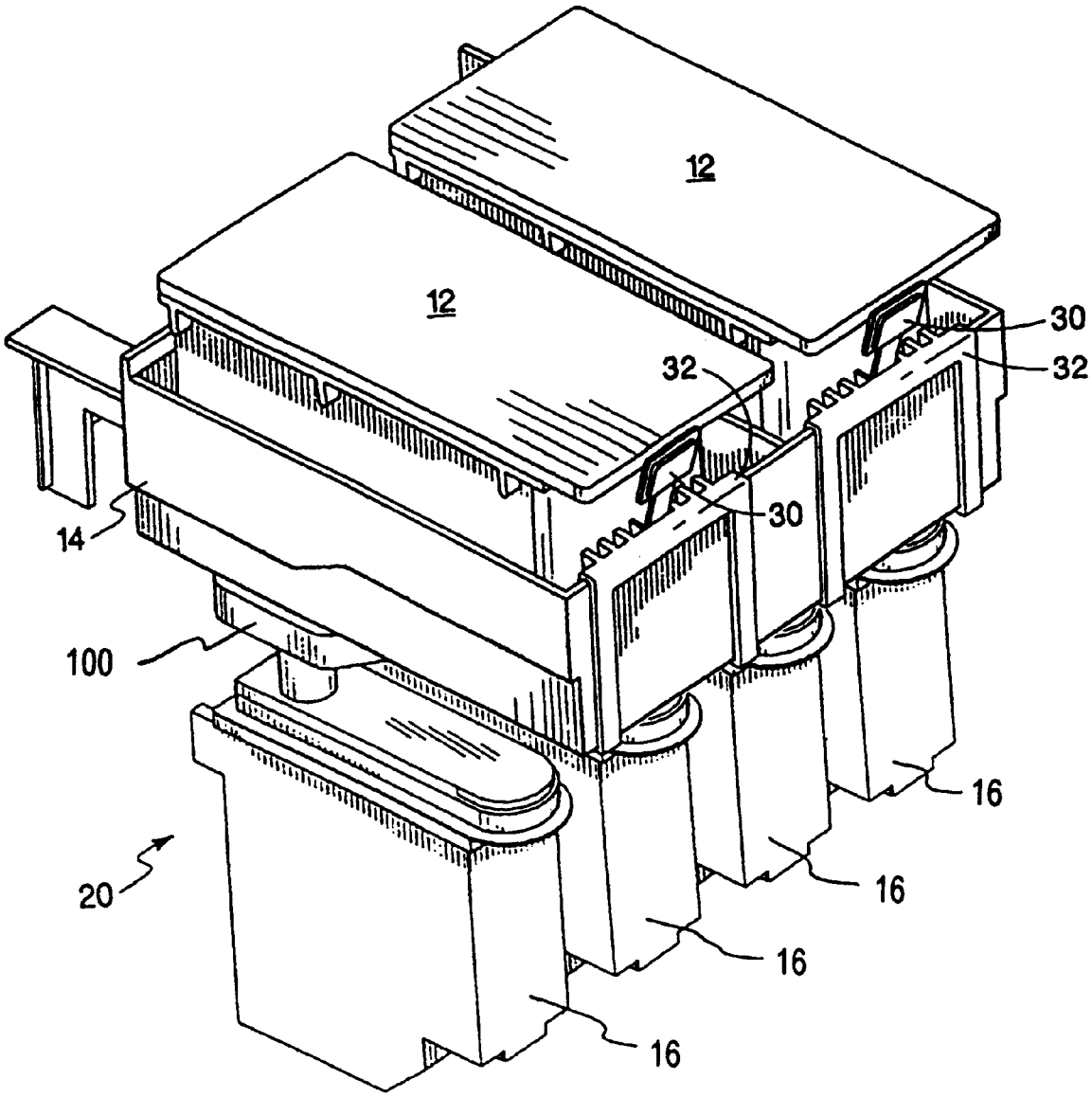
FIG. 2 is an enlarged perspective view of a portion of a scanning carriage showing the replaceable ink containers, the manifold of the present invention, and multiple printheads.

FIG. 2 is a perspective view of a portion of the scanning carriage 20 showing a pair of replaceable ink containers 12, typically one for black ink and one for color ink, properly installed in the receiving station 14. Attached to the base of the receiving station is the manifold 100 of the present invention. Inkjet printheads 16 are in fluid communication with the receiving station 14 through the manifold 100. In the preferred embodiment, the inkjet printing system 10 shown in FIG. 1 includes a tri-color ink container containing three separate ink colors (cyan, magenta, and yellow) and a second ink container containing a single ink color. The replaceable ink containers 12 can be partitioned differently to contain fewer than three ink colors or more than three ink colors if more are required. For example, in the case of high fidelity printing, frequently six or more colors are used to accomplish printing.

Other configurations which make use of fewer than four printheads are also possible. For example, a printhead can be configured to print more than one ink color by properly partitioning the printhead to allow a first ink color to be provided to a first group of ink nozzles and a second ink color to be provided to a second group of ink nozzles, with the second group of ink nozzles different from the first group. In this manner, a single printhead can be used to print more than one ink color allowing fewer than four printheads to accomplish four-color printing. The fluidic path between each of the replaceable ink containers 12 and the printhead 16 will be discussed in more detail with respect to FIG. 3.

Figure 3:
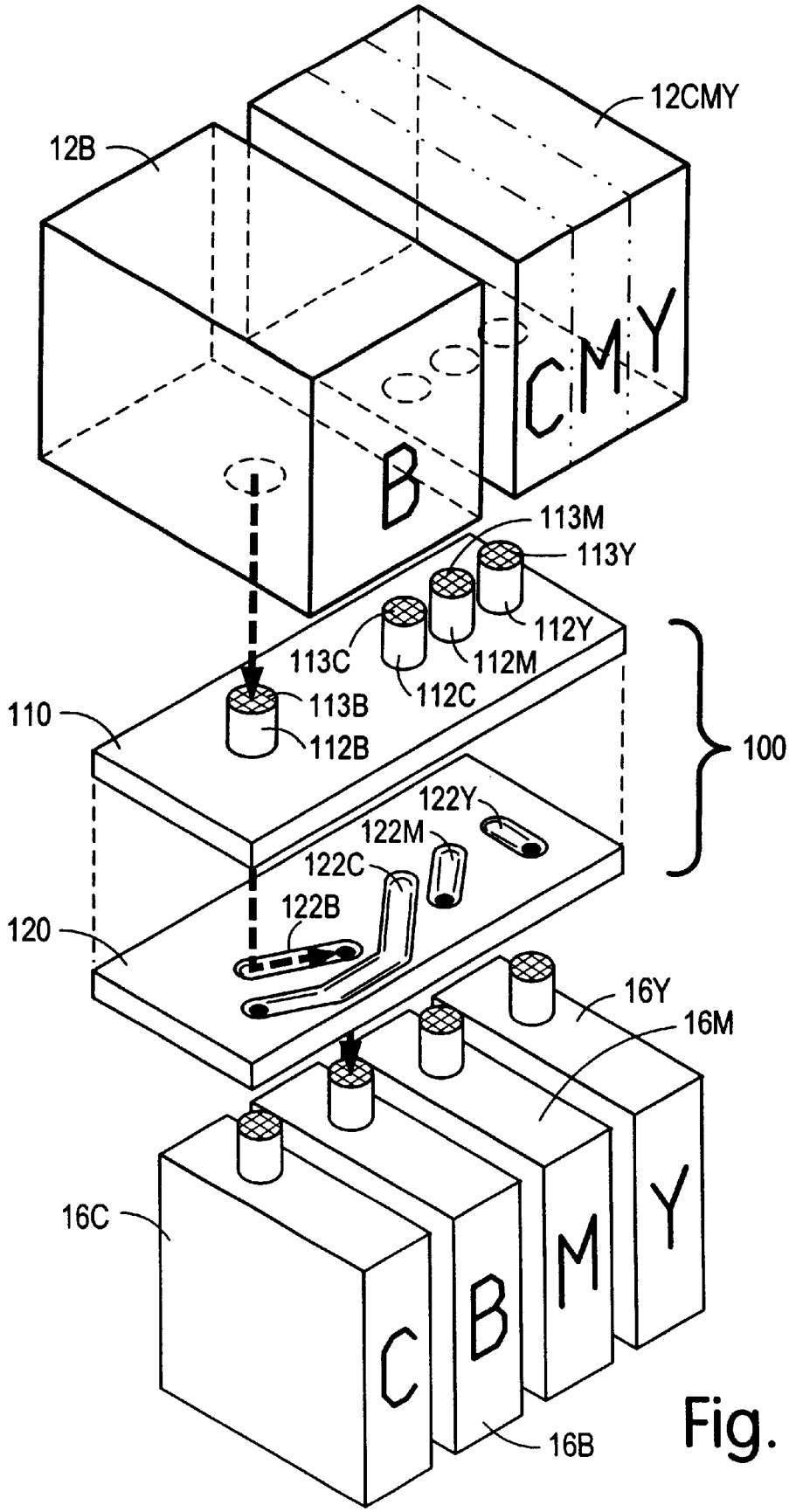
FIG. 3 is a simplified representation of the concept of the present invention, illustrating how ink flows from the replaceable ink containers, through the manifold, to the printheads.
Figure 4A:
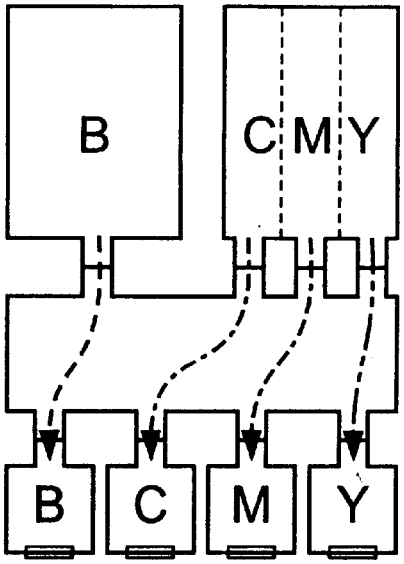
FIGS. 4(*a*) through 4(*f*) are schematic representations of some of the varied configurations of ink supplies and printheads possible utilizing the manifold concept of the present invention.
Figure 4B:
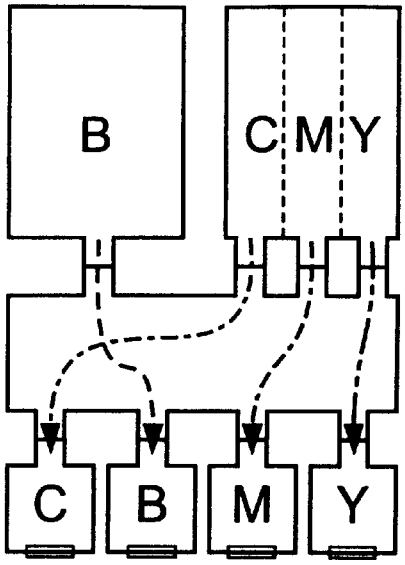
Figure 4C:
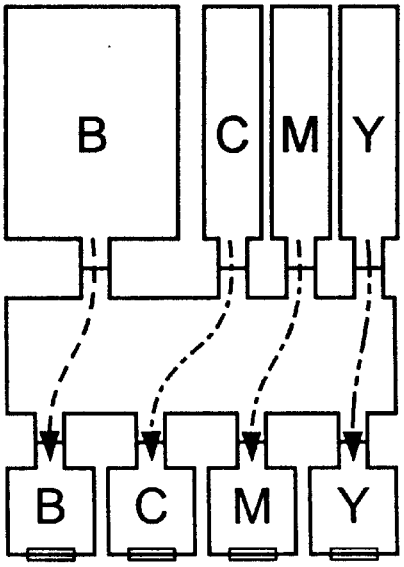
Figure 4D:
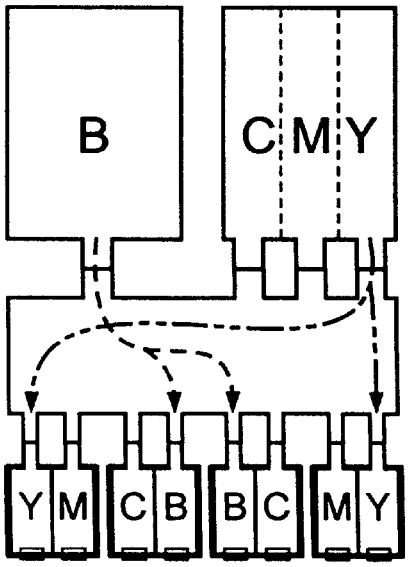
Figure 4E:
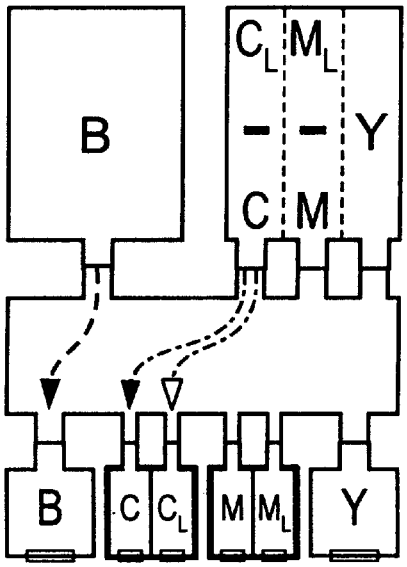
Figure 4F:
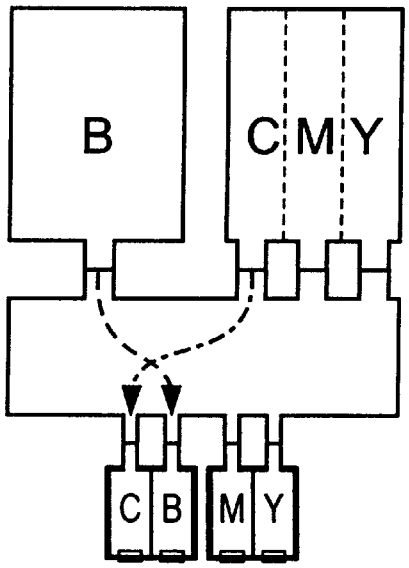

FIG. 3 is a simplified diagram schematically illustrating the manifold concept of the present invention (for clarity, the supporting structure of the receiving station is omitted). The specific configuration of ink reservoirs and printheads illustrated in FIG. 3 is one of many configurations facilitated by the manifold concept, as discuss below. The manifold 100 comprises an upper "supply" plate 110 and lower "pen" plate 120. The preferred embodiment of the manifold employs springloaded seals to provide a secure connection to the ink supplies, as discussed below.

In the manifold configuration illustrated in FIG. 3, a black ink supply 12B supplies ink to tower 112B of the upper or "supply" plate 110 through a metal mesh filter 113B and a tricolor ink supply similarly supplies cyan, magenta, and yellow ink to ink towers 112C, 112M, and 112Y through mesh filters 113C, 113M, and 113Y. Internal channels 122B, 122C, 122M and 122Y within the manifold route the various ink colors to the appropriate printheads 16B, 16C, 16M, and 16Y. As illustrated, the black and cyan inks are "crossed over" to permit underprinting of the black ink regardless of the carriage scan direction, which allows for a shorter drying time the black ink (for illustrative purposes the path followed by the black ink is illustrated with a thick dashed line).

FIGS. 4(*a*) through 4(*f*) schematically illustrate some of the ink supply and printhead configurations enabled by the manifold of the present invention. The present invention allows essentially the same printer hardware to be easily configured for different printing applications by supply a different manifold.

FIG. 4(*a*) illustrates a manifold in which the order of the ink colors is unchanged from the order of inks in the two ink reservoirs. The manifold provides several mechanical advantages over direct fluid connections between the reservoirs and the printheads. The manifold allows the linear spacing of the printheads to optimized, independently of the spacing of the ink reservoir fluid outlets. The manifold further provides additional structural rigidity, in that the forces of removing and inserting new ink reservoirs does not cause misalignment of the printheads. In FIG. 4(*a*), the routing of the black ink is indicated by a simple dashed line; the cyan ink is indicated by an alternating short and long dashed line; the magenta ink is indicated by a two long and one short dashed line; and the yellow ink is represented by a two short and one long dashed line.

FIG. 4(*b*) illustrates the same configuration as described with respect to FIG. 3, wherein the black and cyan supplies are "crossed over". This permits black text to be underprinted with a color ink in either carriage scan direction; underprinting results in the a shorter drying time for the black ink, allowing for higher speed text printing.

FIG. 4(*c*) illustrates that manifolds may be provided which accept different configurations of ink supplies, such as separate reservoirs for each of the primary colors (cyan, magenta, and yellow). In some applications where there is heavier use of one of the primary colors this would allow for a reduction in printing costs, since a partially full tricolor cartridge would not have to be replaced when the heavily used color was used up. Many other configurations of ink supplies are possible, including manifold connections for off-carriage ink supplies.

FIG. 4(*d*) shows a printing configuration wherein the printheads and ink containers have the same spacing, but the printheads are each adapted to eject two colorants. Each printhead has two ejector portions that eject two different colorants. To maximize performance, the ejector portions are symmetrical, with black at the center. This allows for the colors to be printed in the same order in both carriage scan directions, increasing the color print speed accordingly. For clarity, only the paths for the black and yellow inks are shown in FIG. 4(*d*).

FIG. 4(*e*) shows a printing configuration optimized for high-quality color printing. The cyan and magenta colors are divided into separate cyan and cyan light and magenta and magenta light, and the corresponding printheads are likewise divided. For clarity, only the paths for the black and two cyan inks are shown in FIG. 4(*e*).

FIG. 4(*f*) illustrates a low-cost configuration, providing the four print colors in only two printheads. For clarity, only the black and cyan inks are shown in FIG. 4(*f*).

Preferred Embodiment

Figure 5A:
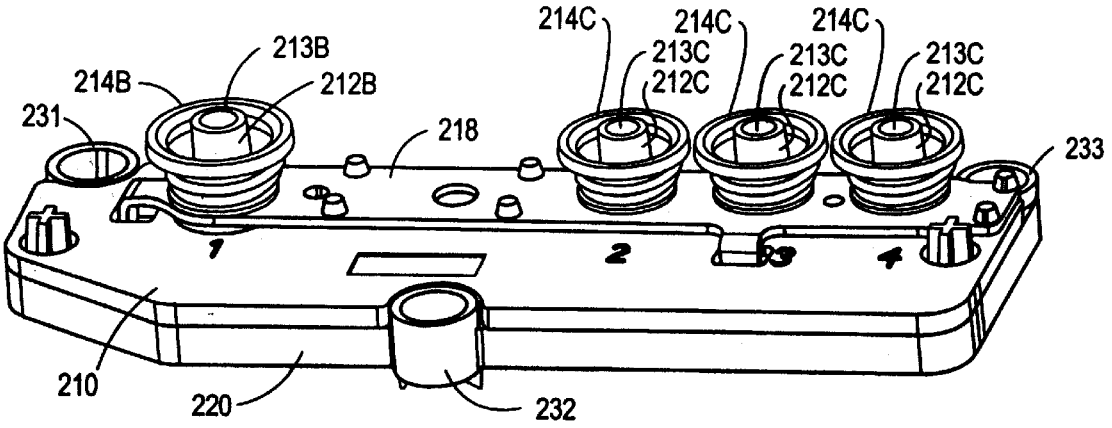
FIGS. 5(*a*) and 5(*b*) are top and bottom perspective views of the presently preferred implementation of the manifold.
Figure 5B:
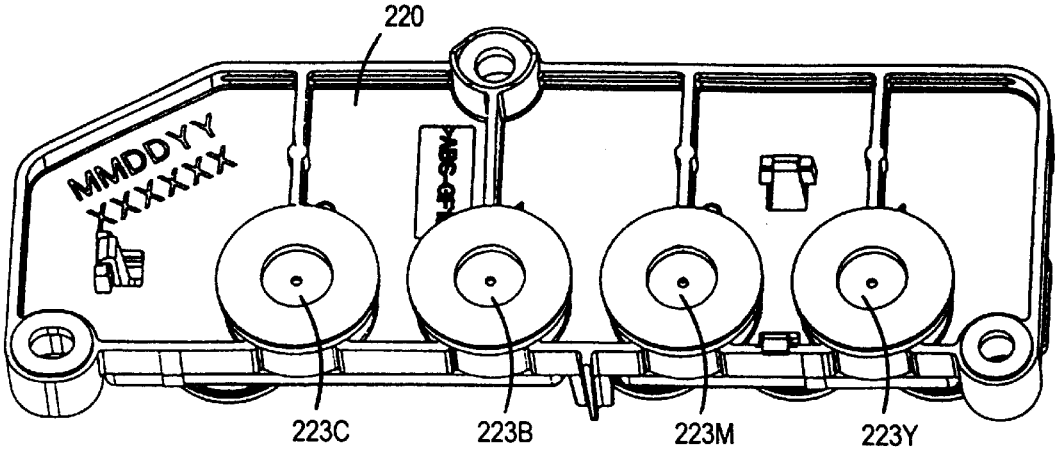

FIG. 5(*a*) is a top perspective view of a presently preferred embodiment of the manifold. The preferred embodiment has an upper plate assembly 210 which includes the ink supply fluid connections and a lower plate 220 which includes the pen fluid connections. Each ink supply fluid connection includes a hollow tower (212B, 212C, 212M, and 212Y) for mating with the fluid of the ink reservoir; each tower has a wire mesh filter (213B, 213C, 213M, and 213Y) near its upper terminus. The preferred embodiment utilizes spring loaded seals (214B, 214C, 214M, and 214Y) to prevent ink leakage, with a retaining plate 218 to retain the seals to the manifold. Although spring loaded seals are utilized in the preferred embodiment, any of the fluid connection methodologies known in the art may be used to provide fluid connections from the ink reservoirs to the manifold. For example, in an alternative embodiment the manifold inlet and outlet fluid connections can be formed via a needle septum combination or a conventional valve means.

Molded into the lower plate 220 are three mounting holes 231, 232, and 233 to allow semi-permanent mounting of the manifold to the printer carriage. The preferred embodiment of the manifold is thus replaceable in the printer system. The manifold may be mounted using screws, snap fit means, or any conventional method for ease of removal and replacement Replacability enables a manifold described with respect to FIG. 4(*a*) to be replaced with a manifold described with respect to FIG. 4(*b*) through 4(*f*), for example. Replacement could be done for a number of reasons, including upgrading performance of an old printer (a printer utilizing the carriage described with respect to FIG. 4(*a*) could be upgraded to the carriage described with respect to FIG. 4[*d*], having the effect of increasing the color print speed of the printer by 50 to 100%).

Another use of an easily installable manifold is to enable modular printing system assembly. A number of different printing systems utilize the same printer chassis, with the particular manifold utilized determining the performance of the printing system. "High end" printing systems and "low end" printing systems could thus utilize the same inventory of printing system chassis, lowering inventory costs (instead of having to stock fully assembled high and low performance printing systems when the relative demand for the two is not fully known).

FIG. 5(*b*) is a bottom perspective view of a preferred embodiment of the manifold. The lower plate includes ink pen fluid connections for each printer pen (223C, 223B, 223K, and 223Y). In the preferred embodiment printer system, the pens include fluid connection mating mechanisms similar to the towers, filters, and seals described above with respect to the upper plate; alternatively, any of the fluid connection methods known in the art may be used to provide fluid connections between the manifold and the printer pens.

Figure 6:
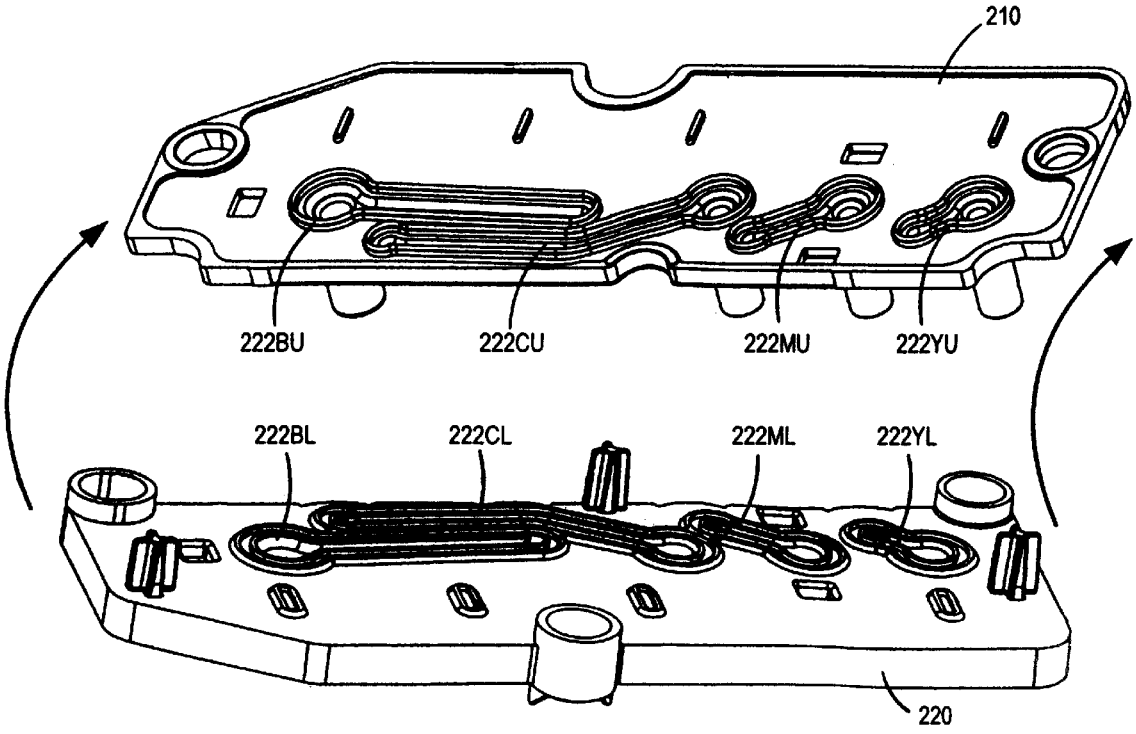
FIG. 6 shows the "supply" and "pen" plates of the preferred embodiment manifold separated to show the internal ink channels.

FIG. 6 illustrates the upper plate 210 and lower plate 220 of the manifold separated to illustrate the formation of the internal ink channels (222BU, 222BL, 222CU, 222CL, 222MU, 222ML, 222YU, and 222YL). Each channel is formed by mating indentations and protuberances injection molded into the upper and lower plate, configured to provide fluid-tight channels when the upper and lower plates are assembled. As discussed above, a channel is provided to route each color of ink from its corresponding ink reservoir connection to its corresponding pen connection.

Although described with respect to ink jet printers, the apparatus and methods of the present invention are applicable to inkjet plotters, copiers, and fax machines, and to similar machines utilizing different print methodologies also having ink reservoirs.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled. The corresponding structures, materials, acts, and equivalents of all means or step plus function elements in the claims below are intended to include any structure, material, or acts for performing the functions in combination with other claimed elements as specifically claimed.

What is claimed is:

1. A printing system having a plurality of carriage-mounted ink supplies and multiple carriage-mounted printheads, a manifold providing fluid connections and mechanical isolation between the ink supplies and the printheads, comprising:

a) a first surface having a plurality of fluid inlets arranged in a substantially linear first array for receiving ink from the ink supplies, the plurality of fluid inlets including inlets for each of the primary colors;

b) a second surface having multiple fluid outlets arranged in a substantially second linear array for dispensing ink to the printheads; the second array substantially parallel to the first array, the multiple fluid outlets including two outlets for each of the primary colors arranged in a first group and second group with each group containing an outlet for each primary color; and c) ink conduits providing fluid connections between each fluid inlet and at least one fluid outlet;

and wherein the ink conduits are configured such that each of the primary color inlets is in fluid communication with a fluid outlet in each of the two groups of fluid outlets and the linear ordering of the primary colors in the first group is the mirror image of the linear ordering of the primary colors in the second group.

2. A printing system, a scan carriage assembly for scanning print mechanisms across print media, comprising:

a) a carriage support structure;

b) a plurality of ink reservoirs releasably retained by the carriage support structure, each ink reservoir having a fluid outlet to dispense ink;

c) multiple printheads mounted to the carriage support structure, each printhead having a fluid inlet to receive ink;

d) a manifold for providing mechanical isolation and fluid connections between the plurality of ink reservoirs and the multiple printheads, the manifold removably mounted to the carriage support structure and having 1) a first surface having a plurality fluid inlets arranged in a substantially linear first array for receiving ink from the ink reservoirs;

2) a second surface having multiple fluid outlets arranged in a substantially linear second array for dispensing ink to the printheads, the second array substantially parallel to the first array; and 3) ink conduits providing fluid connections between each fluid inlet and at least one fluid outlet;

e) each reservoir fluid outlet in fluid connection with a fluid inlet of the manifold, and each printhead fluid inlet in fluid connection with a fluid outlet of the manifold;

and wherein the plurality of manifold fluid inlets on the first surface include inlets for each of the primary colors, the multiple fluid outlets on the manifold second surface include two outlets for each of the primary colors, the primary color fluid outlets arranged in a first group and second group with each group containing an outlet for each primary color, and wherein the ink conduits are configured such that each of the primary color inlets is in fluid communication with a fluid outlet in each of the two groups and the linear ordering of the primary colors in the first group is the mirror image of the linear ordering of the primary colors in the second group.

3. A fluid delivery manifold for providing ink to a plurality of carriage-mounted printheads, the manifold comprising:

a first surface and a second surface;

a plurality of fluid inlets on the first surface including inlets for each of the primary colors;

multiple fluid outlets on the second surface including two outlets for each of primary colors, the primary color fluid outlets arranged in a first group and second group with each group containing an outlet for each primary color;

and wherein the ink conduits are configured such that each of the primary color inlets is in fluid communication with a fluid outlet in each of the two groups and the linear ordering of the primary colors in the first group is the mirror image of the linear ordering of the primary colors in the second group.

* * * * *